US005778810A

United States Patent [19]

Akahane et al.

[11] Patent Number: 5,778,810

[45] Date of Patent: Jul. 14, 1998

[54] SEWING MACHINE

[76] Inventors: Koichi Akahane, Mikage Park Haitsu 1-102, 1-43-2, Mikage-cho, Chikusa-ku, Nagoya-shi, Aichi-ken; Takashi Kondo, 59-5, Terashita, Yokonemachi, Ohbu-shi, Aichi-ken; Motonari Nakano, 30-1, Aza-Kawasaki, Oku-cho, Ichinomiya-shi, Aichi-ken; Yoshihisa Nozaki, 205, Aza-Aoki, Oaza-Akasaka, Otowa-cho, Hoi-gun, Aichi-ken; Koichi Harada, 1-101, Fujishima, Komaki-shi, Aichi-ken; Tomoyuki Fujita, 18-55, Nagase-cho, Tajimi-shi, Gifu-ken; Minoru Yamaguchi, 58-4, Kitadaido, Ogakie-cho, Kariya-shi, Aichi-ken, all of Japan

[21] Appl. No.: 829,339

[22] Filed: Mar. 31, 1997

[30] Foreign Application Priority Data

Apr. 8, 1996 [JP] Japan ..... 8-111983

[51] Int. Cl.[6] ..... D05B 19/00; D05B 69/12

[52] U.S. Cl. ..... 112/470.01; 112/220; 112/275; 112/445

[58] Field of Search ..... 112/275, 277, 112/220, 470.01, 470.06, 445

[56] References Cited

U.S. PATENT DOCUMENTS 4,479,448 10/1984 Jones et al. ..... 112/275
4,987,842 1/1991 Nakamura et al. ..... 112/275
5,458,075 10/1995 Tice et al. ..... 112/275 X

FOREIGN PATENT DOCUMENTS 60-21750 5/1985 Japan .
3-234291 10/1991 Japan .

*Primary Examiner*—Peter Nerbun

[57] ABSTRACT

A sewing machine including a needle bar to which a sewing needle conveying a sewing thread is secured, a main shaft to which the needle bar is connected, a loop catcher which cooperates with the sewing needle to catch a loop of the sewing thread conveyed by the needle, a catcher shaft to which the loop catcher is connected, a drive motor which drives at least one of the needle bar and the loop catcher by rotating a corresponding one of the main shaft and the catcher shaft, a first sensor which detects a first reference rotation position of at least one of the main shaft and the catcher shaft and generates a first detection signal indicating that the one shaft is taking the first reference rotation position, a second sensor which detects a second reference rotation position of the drive motor and generates a second detection signal indicating that the drive motor is taking the second reference rotation position, and an indicating device which indicates, based on the first detection signal, that the one of the main shaft and the catcher shaft is taking the first reference rotation position and indicates, based on the second detection signal, that the drive motor is taking the second reference rotation position.

24 Claims, 13 Drawing Sheets

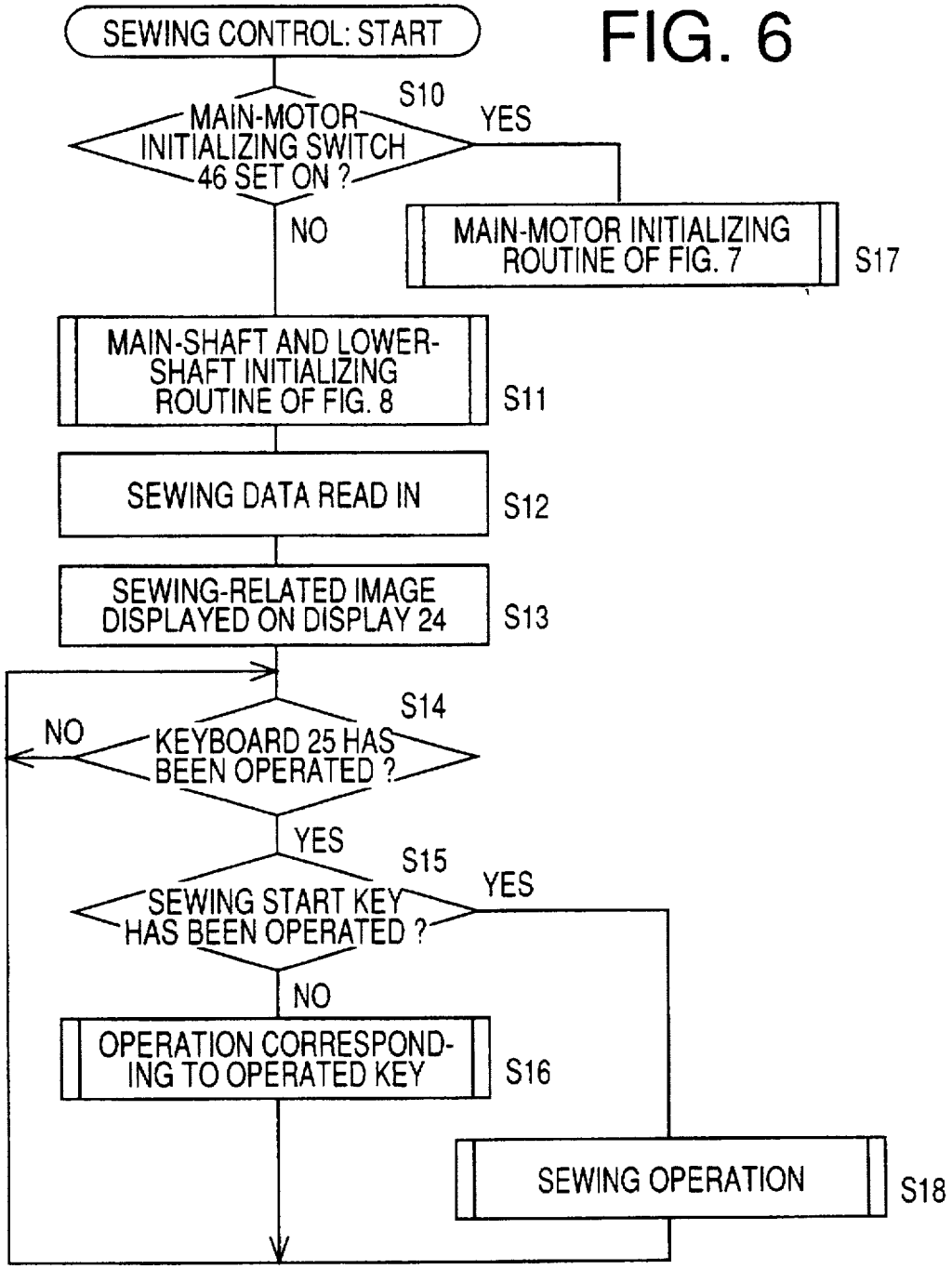
FIG. 6
SEWING CONTROL: START
S10
MAIN-MOTOR INITIALIZING SWITCH 46 SET ON ?
YES
NO
MAIN-MOTOR INITIALIZING ROUTINE OF FIG. 7
S17
MAIN-SHAFT AND LOWER-SHAFT INITIALIZING ROUTINE OF FIG. 8
S11
SEWING DATA READ IN
S12
SEWING-RELATED IMAGE DISPLAYED ON DISPLAY 24
S13
S14
NO
KEYBOARD 25 HAS BEEN OPERATED ?
YES
S15
SEWING START KEY HAS BEEN OPERATED ?
YES
NO
OPERATION CORRESPONDING TO OPERATED KEY
S16
SEWING OPERATION
S18

SEWING MACHINE

BACKGROUND OF THE INVENTION

1. Field of the Invention

The present invention relates to the improvement of a sewing machine.

2. Related Art Statement

There is known a sewing machine which is essentially provided by a sewing bed, a column portion, an arm portion, and a sewing head. A main shaft which is driven by a main motor is provided in the arm portion, and a needle bar to which a sewing needle is secured, and a take-up lever, of the sewing head are reciprocated or driven by the driving force of the main shaft. A lower shaft and a loop catcher which cooperates with the sewing needle are provided in the sewing bed. The lower shaft is also driven or rotated by the driving force obtained from the main shaft. Thus, the loop catcher is rotated in synchronism with the reciprocation of the sewing needle.

In the case where a sewing machine is provided with an exclusive drive motor which drives a loop catcher independent of a main shaft, the instantaneous rotating state of the loop catcher can be controlled depending upon given sewing conditions, while the rotation of the loop catcher is synchronized with the rotation of the main shaft.

For example, Japanese Patent Application laid open for opposition under Publication No. 60(1985)-21750 discloses a sewing machine including a needle drive motor for driving a sewing needle and a loop-catcher drive motor for driving a loop catcher. In this machine, the two motors are controlled such that the sewing needle and the loop catcher are synchronized with each other to form a series of perfect stitches.

In addition, Japanese Patent Application laid open for inspection under Publication No. 3(1991)-234291 discloses a sewing machine including a needle drive motor for driving a sewing needle via an upper or main shaft, and a loop-catcher drive motor for driving, via a lower shaft, a loop catcher independent of the main shaft. A rotary encoder detects the amount of rotation of the main shaft and, when the main shaft is rotated with a hand of a user, the loop-catcher drive motor is rotated by the same amount as that of the main shaft, by a synchronizing device. Thus, the sewing needle and the loop catcher are operated while the synchronism of the two elements is maintained.

In order to synchronize the respective rotations of a main shaft driven by a needle drive motor and a lower shaft driven by a loop-catcher drive motor, it is needed to detect an origin rotation position or angular phase of the main shaft and a current rotation position of the main shaft as measured from its origin position, and an origin rotation position of the lower shaft and a current rotation position of the lower shaft as measured from its origin position. To this end, conventional sewing machines employ a first rotary encoder associated with the main shaft, a second rotary encoder associated with the lower shaft, a control device for synchronizing the respective rotations of the two shafts based on the respective detection signals supplied from the two encoders.

In the case where a servomotor incorporating a rotary encoder is employed as a needle drive motor, i.e., main motor and a main-shaft origin sensor is employed for detecting the origin rotation position of a main shaft corresponding to the upper dead position of a needle bar, the rotary encoder generates a reference-position signal (i.e., Z-phase signal) indicating that a reference rotation position of the servomotor is being detected, and also generates close pulse signals each of which is indicative of a current rotation position of the servomotor as measured from the reference position.

It is impossible for a user to connect, with his or her hand only, the main motor to the main shaft such that the reference position of the main motor is accurately aligned with the origin position of the main shaft. Hence, upon application of an electric power to the sewing machine, the main motor is rotated at a low speed so that the rotary encoder may detect the reference position of the main motor, and the main motor is further driven so that the main-shaft origin sensor may detect the origin position of the main shaft. Thus, the control device determines the phase difference between the main-shaft origin position and the main-motor reference position, and synchronizes the respective rotations of the main shaft and the lower shaft based on the thus determined phase difference and each of the clock pulse signals supplied from the rotary encoder. That is, the control device can calculate various timings including respective timings when the sewing needle takes its upper and lower dead positions, a timing when sewing threads are cut, a meeting timing when the sewing needle and a point of hook of the loop catcher meet each other.

When the main motor is rotated for detecting the reference position thereof upon application of the electric power to the sewing machine, one full turn of the main motor may be needed depending upon the current position thereof relative to the reference position. In this case, the main shaft connected to the main motor is rotated by one full turn and accordingly the needle bar connected to the main shaft is moved up and down. Thus, the sewing needle secured to the needle bar may collide with the loop catcher. To avoid this problem, it is possible to add a mark to each of an output shaft and a housing of the main motor, so that the user can manually align the output shaft of the motor to the reference position thereof. In this case, however, those marks must be added such that the marks are aligned with the reference position with accuracy. This leads to increasing the production cost of the main motor.

When the phase difference between the main-shaft origin position and the main-motor reference position is detected upon application of the electric power to the sewing machine, the needle bar may be retracted to its upper dead position corresponding to the origin position of the main shaft. In this case, however, one full turn of the main shaft may be needed if the main shaft is rotated in one direction only. Thus, the sewing needle secured to the needle bar may collide with the loop catcher. To avoid this problem, it is possible to employ a needle-position sensor which generates different detection signals when the sewing needle is moved up from its lower dead position to its upper dead position and when the needle is moved down from its upper dead position to its lower dead position, respectively, and a control device which determines or selects, based on the needle-position signal supplied from the sensor, one of opposite rotation directions of the main shaft which ensures that the sewing needle is directly moved to its upper dead position without being routed via its lower dead position. In this case, the sewing needle is effectively prevented from colliding with the loop catcher. However, since the needle-position sensor is employed in addition to the main-shaft origin sensor, the sewing machine suffers from the problems that the production cost thereof is increased and the assembling thereof is complicated.

SUMMARY OF THE INVENTION

It is therefore a first object of the present invention to provide a sewing machine in which a drive motor is easily connected to a drive shaft.

It is a second object of the present invention to provide a sewing machine in which a reference rotation position of a drive shaft is easily detected.

The first object has been achieved according to a first aspect of the present invention which provides a sewing machine comprising a needle bar to which a sewing needle conveying a sewing thread is secured, a main shaft to which the needle bar is connected, a loop catcher which cooperates with the sewing needle to catch a loop of the sewing thread conveyed by the needle, a catcher shaft to which the loop catcher is connected, a drive motor which drives at least one of the needle bar and the loop catcher by rotating a corresponding one of the main shaft and the catcher shaft, a first sensor which detects a first reference rotation position of at least one of the main shaft and the catcher shaft and generates a first detection signal indicating that the one shaft is taking the first reference rotation position, a second sensor which detects a second reference rotation position of the drive motor and generates a second detection signal indicating that the drive motor is taking the second reference rotation position, and an indicating device which indicates, based on the first detection signal, that the one of the main shaft and the catcher shaft is taking the first reference rotation position and indicates, based on the second detection signal, that the drive motor is taking the second reference rotation position.

In the sewing machine in accordance with the first aspect of the invention, the main shaft or the catcher shaft may be rotated with a hand of a user or an operator and, when the main shaft or the catcher shaft takes the first reference position, the first sensor detects it and the indicating device indicates that the main shaft or the catcher shaft is taking the first reference position. In addition, an output shaft of the drive motor may be manually rotated by the user and, when the drive motor takes the second reference position, the second sensor detects it and the indicating device indicates that the drive motor is taking the first reference position. Thus, the drive motor can be connected to the main shaft or the catcher shaft such that only a small phase difference is left between the first and second reference positions of the drive motor and the main or catcher shaft.

According to a preferred feature of the first aspect of the invention, the drive motor comprises a main motor which drives at least the needle bar by rotating the main shaft, the first sensor comprises a main-shaft sensor which detects the first reference rotation position of the main shaft and generates the first detection signal indicating that the main shaft is taking the first reference rotation position, the second sensor comprises a main-motor sensor which detects the second reference rotation position of the main motor and generates the second detection signal indicating that the main motor is taking the second reference rotation position, and the indicating device indicates, based on the first detection signal, that the main shaft is taking the first reference rotation position and indicates, based on the second detection signal, that the main motor is taking the second reference rotation position.

According to another feature of the first aspect of the invention, the drive motor further comprises a catcher drive motor which is independent of the main motor and which drives the loop catcher by rotating the catcher shaft. Upon application of an electric current to the present sewing machine, the main shaft may be rotated to the first reference position, or the main motor may be rotated to the second reference position, while the sewing needle connected to the main shaft is effectively prevented from colliding with the loop catcher, if the main motor is rotated in an appropriate direction. The first reference position may correspond to the upper dead position of the needle bar.

According to another feature of the first aspect of the invention, the main-motor sensor generates a rotation-position detection signal representative of a current rotation position of the main motor, and the sewing machine further comprises a control device which controls the catcher drive motor, based on the rotation-position detection signal, such that the catcher drive motor rotates the catcher shaft in synchronism with the rotation of the main shaft by the main motor.

According to another feature of the first aspect of the invention, the sewing machine further comprises a non-volatile memory which stores a first control program according to which the indicating device operates, and a second control program according to which the control device operates. In this case, the two control programs can be simultaneously written or stored in the non-volatile memory. Thus, the memory can be easily treated.

According to another feature of the first aspect of the invention, the drive motor comprises a catcher drive motor which drives the loop catcher by rotating the catcher shaft, the first sensor comprises a catcher-shaft sensor which detects the first reference rotation position of the catcher shaft and generates the first detection signal indicating that the catcher shaft is taking the first reference rotation position, the second sensor comprises a catcher-drive-motor sensor which detects the second reference rotation position of the catcher drive motor and generates the second detection signal indicating that the catcher drive motor is taking the second reference rotation position, and the indicating device indicates, based on the first detection signal, that the catcher shaft is taking the first reference rotation position and indicates, based on the second detection signal, that the catcher drive motor is taking the second reference rotation position.

According to another feature of the first aspect of the invention, the indicating device comprises a display which displays at least one of a first character and a first symbol indicating that the at least one of the main shaft and the catcher shaft is taking the first reference rotation position and displays at least one of a second character and a second symbol indicating that the drive motor is taking the second reference rotation position. In this case, the user can easily recognize that the main shaft or the catcher shaft is taking the first reference rotation position and that the drive motor is taking the second reference rotation position.

According to another feature of the first aspect of the invention, the indicating device comprises a speaker which generates a first sound indicating that the at least one of the main shaft and the catcher shaft is taking the first reference rotation position and generates a second sound indicating that the drive motor is taking the second reference rotation position.

According to another feature of the first aspect of the invention, the indicating device comprises a first lamp which is turned on indicate that the at least one of the main shaft and the catcher shaft is taking the first reference rotation position, and a second lamp which is turned on to indicate that the drive motor is taking the second reference rotation position.

According to another feature of the first aspect of the invention, the first sensor comprises a detection plate which is secured to the at least one of the main shaft and the catcher shaft, and a detection signal generator which generates the first detection signal having a first feature while the detection plate is rotated about the one shaft within a first half angular range of 180 degrees, and generates the first detection signal having a second feature while the detection plate is rotated within a second half angular range of 180 degrees which does not overlap the first half angular range.

According to another feature of the first aspect of the invention, the detection plate comprises a semicircular plate which is secured to the at least one of the main shaft and the catcher shaft and which has two radial edges which are opposite to each other with respect to the one shaft, one of the two radial edges corresponding to the first reference rotation position of the one shaft.

According to another feature of the first aspect of the invention, the signal generator comprises a transmission type photodetector which emits a light toward the semicircular plate and receives the emitted light and which generates the first detection signal having the first feature indicating that the emitted light has not been received because of interruption of the semicircular plate and generates the first detection signal having the second feature indicating that the emitted light has been received.

According to another feature of the first aspect of the invention, the two radial edges correspond to an upper and a lower dead position of the needle bar connected to the main shaft, respectively. In this case, based on the first detection signal having the first or second feature, supplied from the detection signal generator, the drive motor can be rotated in an appropriate direction so that the needle bar may be directly moved to its upper dead position without being moved via its lower dead position. Thus, the sewing needle is effectively prevented from colliding with the loop catcher. In addition, the present sewing machine need not employ an exclusive needle-position sensor which detects a current position of the sewing needle.

According to another feature of the first aspect of the invention, the detection plate comprises a circular plate which is secured to the at least one of the main shaft and the catcher shaft and which includes two semicircular portions having different reflection coefficients, respectively, the circular plate having two radial boundaries which are opposite to each other with respect to the one shaft and which cooperate with each other to separate the two semicircular portions from each other, one of the two radial boundaries corresponding to the first reference rotation position of the one shaft.

According to another feature of the first aspect of the invention, the detection signal generator comprises a reflection-type photodetector which emits a light toward the circular plate and receives the light emitted and reflected by the circular plate and which generates the first detection signal having the first feature indicating that the emitted light has been reflected by one of the two semicircular portions and generates the first detection signal having the second feature indicating that the emitted light has been reflected by the other of the two semicircular portions.

According to another feature of the first aspect of the invention, the sewing machine further comprises a coupling device which couples an output shaft of the drive motor with the at least one of the main shaft and the catcher shaft, such that the drive motor is detachable from the one shaft. In this case, the main motor can be easily connected to, and disconnected from, the main shaft.

According to another feature of the first aspect of the invention, the sewing machine further comprises an error informing device which informs that a phase difference between the first and second reference rotation positions is greater than a reference angle. The reference angle may be predetermined at a value which ensures that the sewing needle secured to the needle bar does not collide with the loop catcher. Therefore, even in the case where an excessively great phase difference is produced between the first and second reference rotation positions, because of, e.g., loosening of the coupling device, the sewing needle is effectively prevented from colliding with the loop catcher.

The second object has been achieved according to a second aspect of the present invention which provides a sewing machine comprising a needle bar to which a sewing needle conveying a sewing thread is secured, a main shaft to which the needle bar is connected, a loop catcher which cooperates with the sewing needle to catch a loop of the sewing thread conveyed by the needle, a catcher shaft to which the loop catcher is connected, a drive motor which drives at least one of the needle bar and the loop catcher by rotating a corresponding one of the main shaft and the catcher shaft, and a rotation-position sensor which detects a reference rotation position of at least one of the main shaft and the catcher shaft and generates a first detection signal indicating that the one shaft is taking the reference rotation position, the rotation-position sensor including a detection plate which is secured to the at least one of the main shaft and the catcher shaft, and a signal generator which generates a second detection signal having a first feature while the detection plate is rotated about the one shaft within a first half angular range of 180 degrees, and generates the second detection signal having a second feature while the detection plate is rotated within a second half angular range of 180 degrees which does not overlap the first half angular range.

In the sewing machine in accordance with the second aspect of the invention, the main shaft or the catcher shaft may reach the reference rotation position by being rotated in an appropriate direction over the shorter angle than the rotation angle needed when the shaft is rotated in the opposite direction. For example, in the case where the reference rotation position of the main shaft corresponds to the upper dead position of the needle bar, the main shaft may be rotated to move the needle bar up to the upper dead position without moving the needle bar down to the lower dead position. Thus, the sewing needle is effectively prevented from colliding with the loop catcher. In addition, the present sewing machine need not employ an exclusive needle-position sensor which detects a current position of the sewing needle.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 6 is a flow chart representing a sewing control program according to which the control device controls a sewing operation of the sewing machine of FIG. 1;

DETAILED DESCRIPTION OF THE PREFERRED EMBODIMENTS

Figure 1:
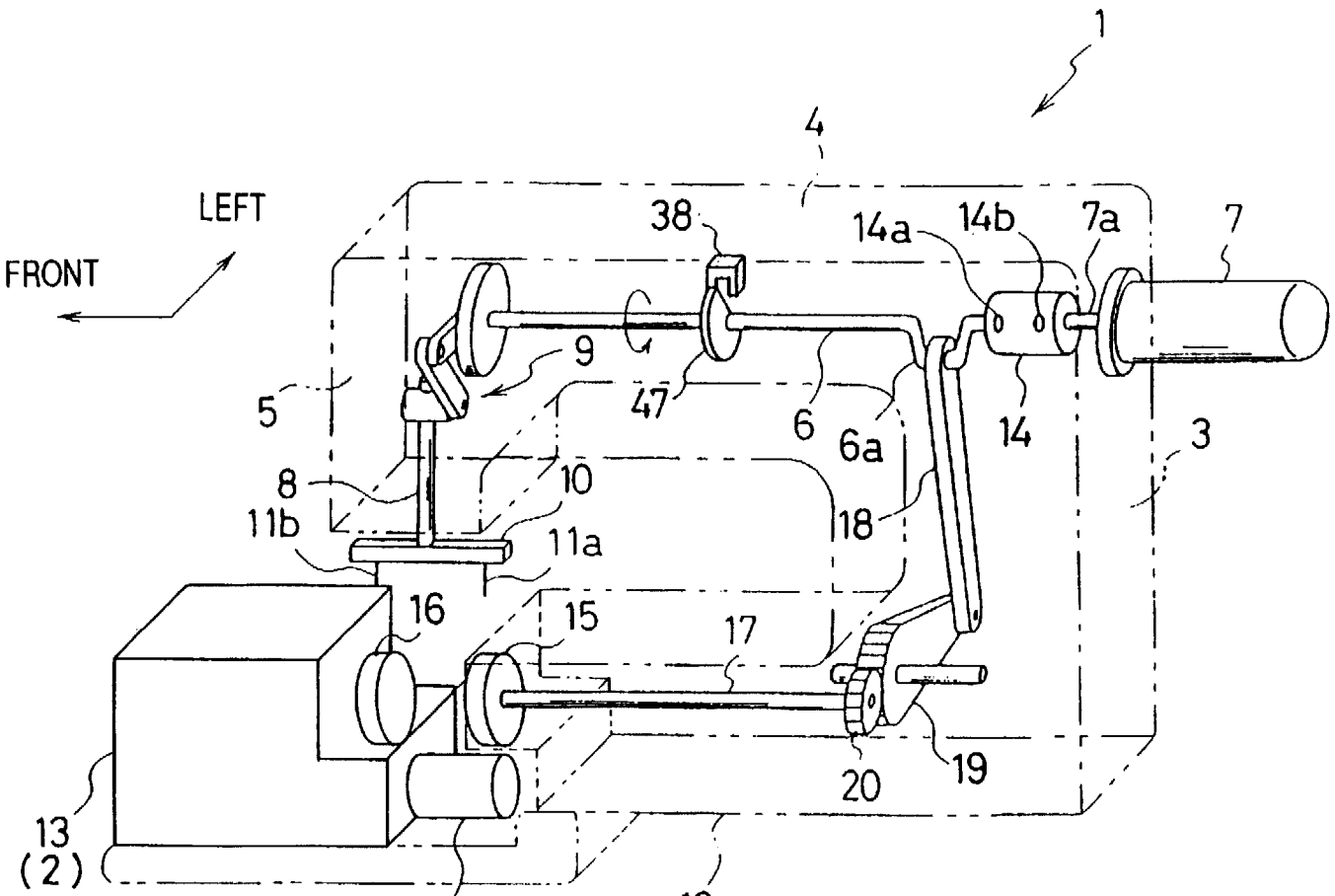
FIG. 1 is a perspective view of a double-needle sewing machine to which the present invention is applied.

Referring to FIG. 1, there is shown a double-needle sewing machine 1 to which the present invention is applied. The double-needle sewing machine 1 is used for simultaneously forming two bar-like stop stitch patterns at opposite two ends of a belt-pass loop which is to be sewn to a waist portion of a pair of trousers.

The sewing machine 1 includes a bed 2, a column 3 which extends upward from a rear end portion of the bed 2, an arm 4 which extends horizontally frontward from an upper end portion of the column 3, and a head 5.

A main shaft 6 which extends in the arm 4 is connected via a coupling member 14 to a main motor 7 which is provided by an induction motor. A needle bar 8 is connected via a crank mechanism 9 to the main shaft 6. When the main motor 7 is driven and an output shaft 7*a* of the motor 7 is rotated, the main shaft 6 is rotated and the needle bar 8 is moved up and down. A pair of sewing needles 11*a*, 11*b* are secured to a needle support 10 provided at a lower end of the needle bar 8, such that one 11*b* of the two sewing needles 11*a*, 11*b* is adjustable with respect to its position relative to the other needle 11*a* in a direction parallel to the main shaft 6. The main shaft 6 is secured to the coupling member 14 with a first set vis 14*a* such that the shaft 6 is detachable from the coupling 14, and the main motor 7 is secured to the coupling member 14 with a second set vis 14*b* such that the motor 7 is detachable from the coupling 14.

Figure 5:
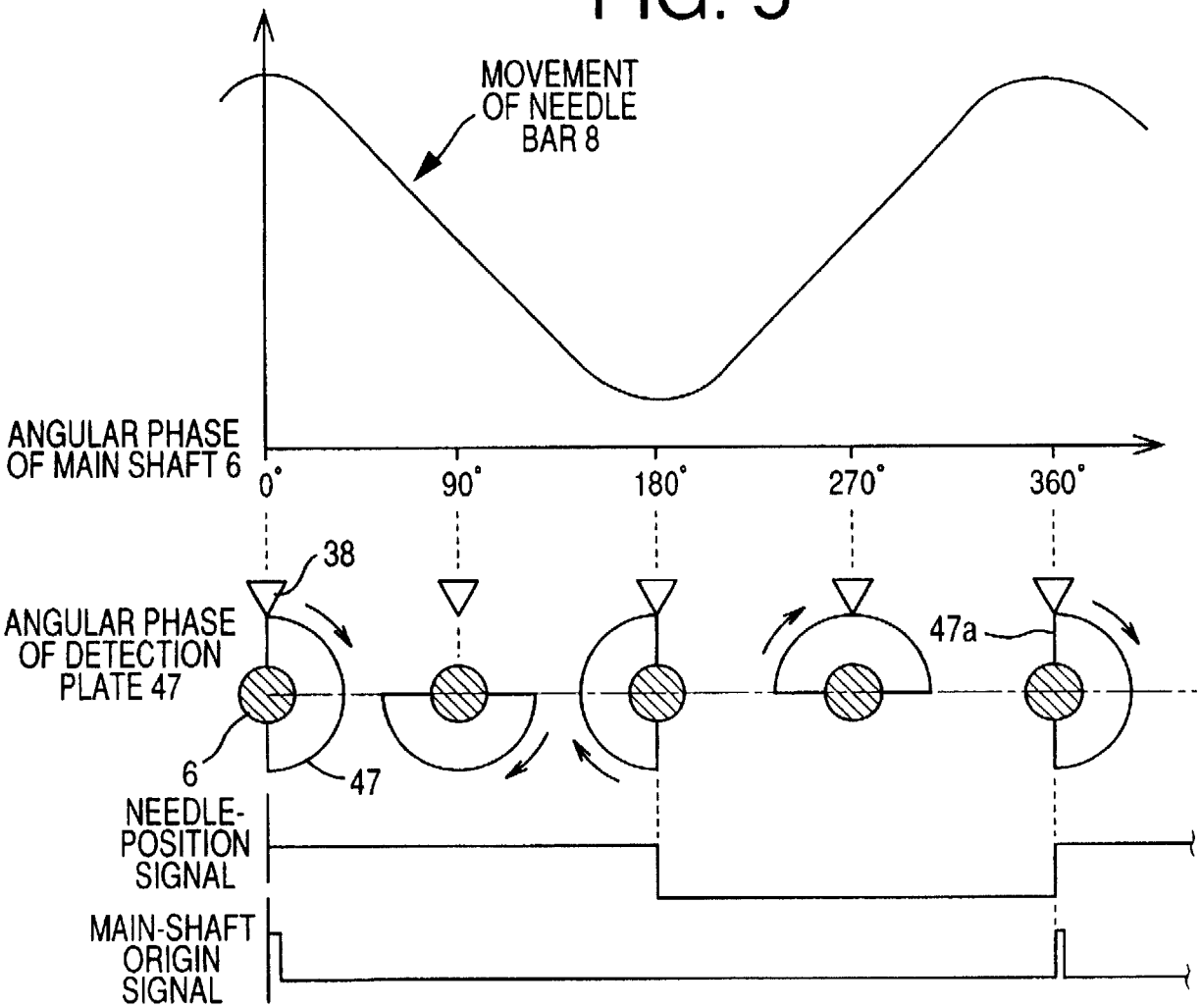
FIG. 5 is a graph illustrating the movement of a needle bar, the change of rotation position of a detection plate, and the respective changes of various signals, with respect to the change of rotation position of a main shaft of the sewing machine of FIG. 1.

A semicircular detection plate 47 is fixed to the main shaft 6. When the main shaft 6 is rotated, the detection plate 47 is also rotated and interrupts an optical path of a light emitted by a light emitter (not shown) of a main-shaft origin sensor 38 which is provided by a photointerrupter which additionally includes a light detector for detecting the light emitted by the light emitter. As shown in FIG. 5, while the needle bar 8 is moved down from its upper dead position to its lower dead position, that is, while the main shaft 6 is rotated within a first half angular range of 0° to 180°, the sensor 38 generates a needle-position signal having a "H" (high) level, because the light emitted by the light emitter is not interrupted by the detection plate 47. On the other hand, while the needle bar 8 is moved up from the lower dead position to the upper dead position, that is, while the main shaft 6 is rotated within a second half angular range of 180° to 360°, the sensor 38 generates the needle-position signal having a "L" (low) level, because the light emitted by the light emitter is interrupted by the detection plate 47. When the needle bar 8 is just taking its upper dead position, the sensor 38 detects one 47*a* of two radial edges of the semicircular plate 47, and generates a main-shaft origin signal indicating that the bar 8 is just taking the upper dead position, that is, that the main shaft 6 is taking its origin rotation position. The main-shaft origin sensor and the semicircular detection plate corresponds to a rotation-position sensor. The main-shaft origin position corresponds to a reference rotation position. The main-shaft origin signal-corresponds to a first detection signal. The needle-position signal corresponds to a second detection signal.

The bed 2 includes a main bed portion 12 and a shuttle module 13 which is provided in front of the main bed portion 12 such that the two elements 12, 13 are spaced from each other by a predetermined distance. A first half-rotation shuttle 15 as a first loop catcher is provided in a front end portion of the main bed portion 12. A second half-rotation shuttle 16 is provided in a rear end portion of the shuttle module 13. A bobbin (not shown) around which a bobbin thread is wound is accommodated in each of the two shuttles 15, 16. A first lower shaft 17 extends in the main bed portion 12, and a gear 20 is fixed to a rear end of the lower shaft 17. The gear 20 is meshed with a sector gear 19 which in turn is connected via a crank rod 18 to a crank portion 6*a* of the main shaft 6. The first shuttle 15 is fixed to the front end of the first lower shaft 17. Thus, when the main shaft 6 is rotated by the main motor 7, the gear 20 is rotated in alternately opposite directions, and accordingly the first shuttle 15 is rotated in synchronism with the reciprocative upward and downward movement of the sewing needle 11*a*.

The shuttle module 13 is provided by a unit including the second shuttle 16 and a shuttle drive motor 21 which drives and rotates a second lower shaft (not shown) to which the second shuttle 16 is fixed. Thus, the shuttle drive motor 21 is independent of the main motor 7. A control device 30 (FIG. 2) controls the shuttle drive motor 21 such that the second lower shaft or second shuttle 16 is rotated in synchronism with the rotation of the main shaft 6 or the upward and downward movement of the sewing needle 11*b*. Thus, a pair of bar-like stop stitch patterns are simultaneously formed on an object to be sewn.

The present double-needle sewing machine 1 additionally includes a needle-thread take-up mechanism (not shown) for taking up respective needle threads conveyed by the two sewing needles 11*a*, 11*b*, and a feeding mechanism for feeding an object to be sewn, in an X direction perpendicular to the main shaft 6 and a Y direction perpendicular to the X direction, i.e., parallel to the main shaft 6. The X-direction and Y-direction movements of the object are effected independent of each other. Since, however, those mechanisms are well known in the art, no detailed description thereof is provided.

Figure 2:
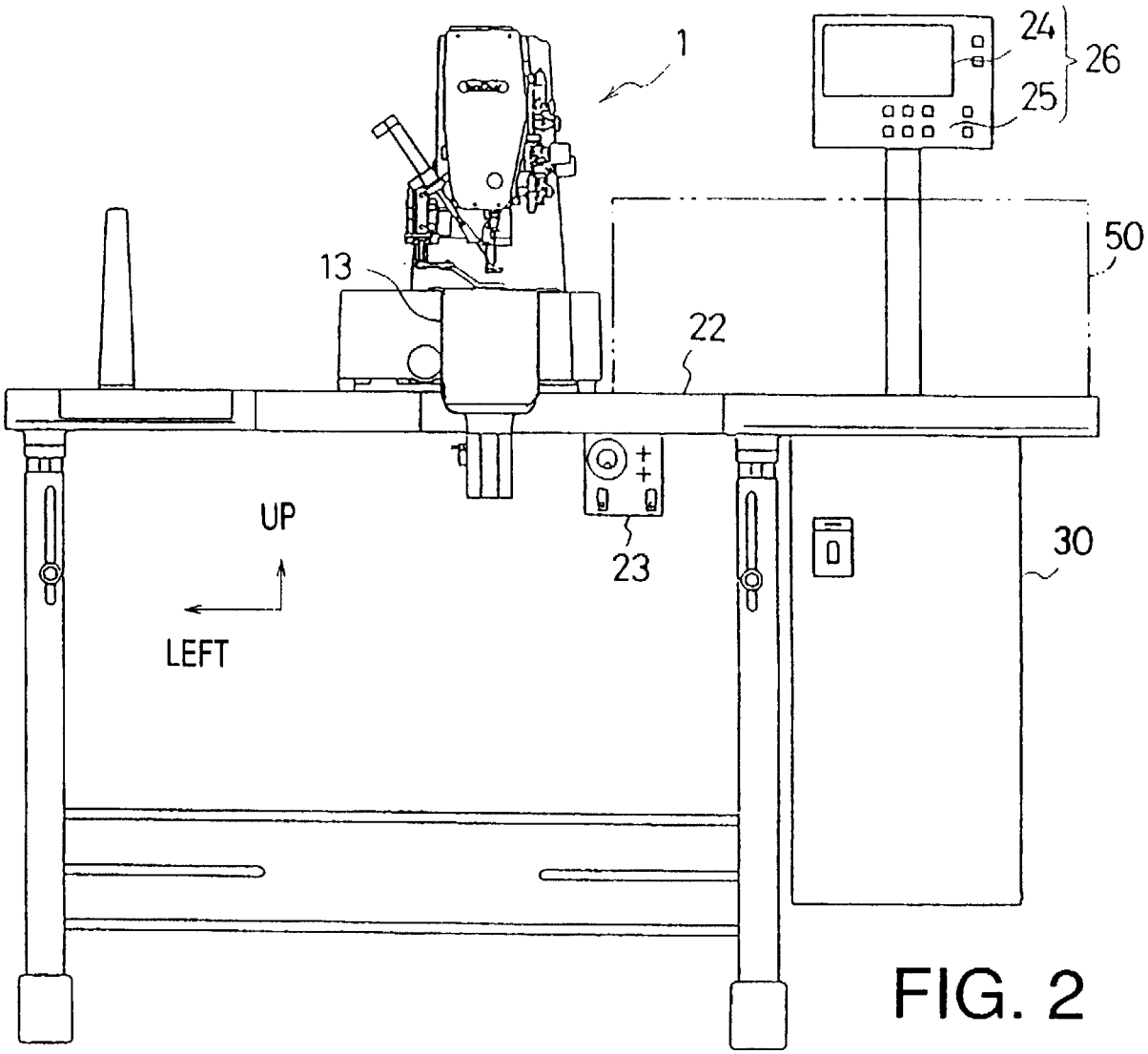
FIG. 2 is a front side view of the sewing machine of FIG. 1.
Figure 3:
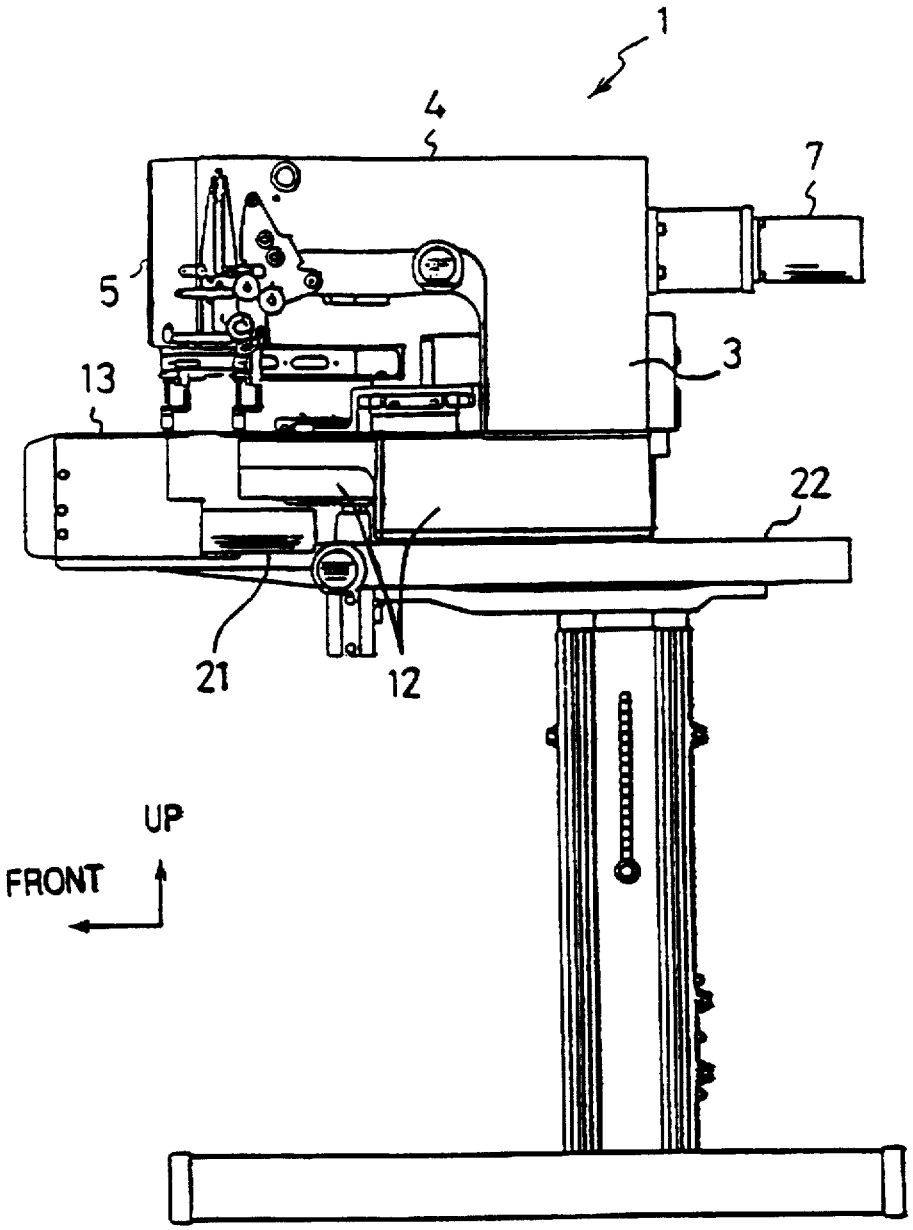
FIG. 3 is a right-hand side view of the sewing machine of FIG. 1.

FIGS. 2 and 3 show a work table 22 on a central portion of which the sewing machine 1 is provided. The control device 30 and a manually operable unit 23 are provided under the work table 22. The unit 23 is manually operable by an operator for rotating, as needed, the main shaft 6 or the second lower shaft (not shown) connected to the second shuttle 16, on a step-by-step basis, that is, little by little. An operator's panel 26 including a liquid crystal display (LCD) 24 and a keyboard 25 is provided at a right-hand end of the work table 22. In addition, a belt-pass loop supplying device 50 which supplies an elongate continuous material for being cut into a plurality of short belt-pass loops, is provided near the operator's panel 26. The supplying device 50 is electrically connected to the control device 30.

Figure 4:
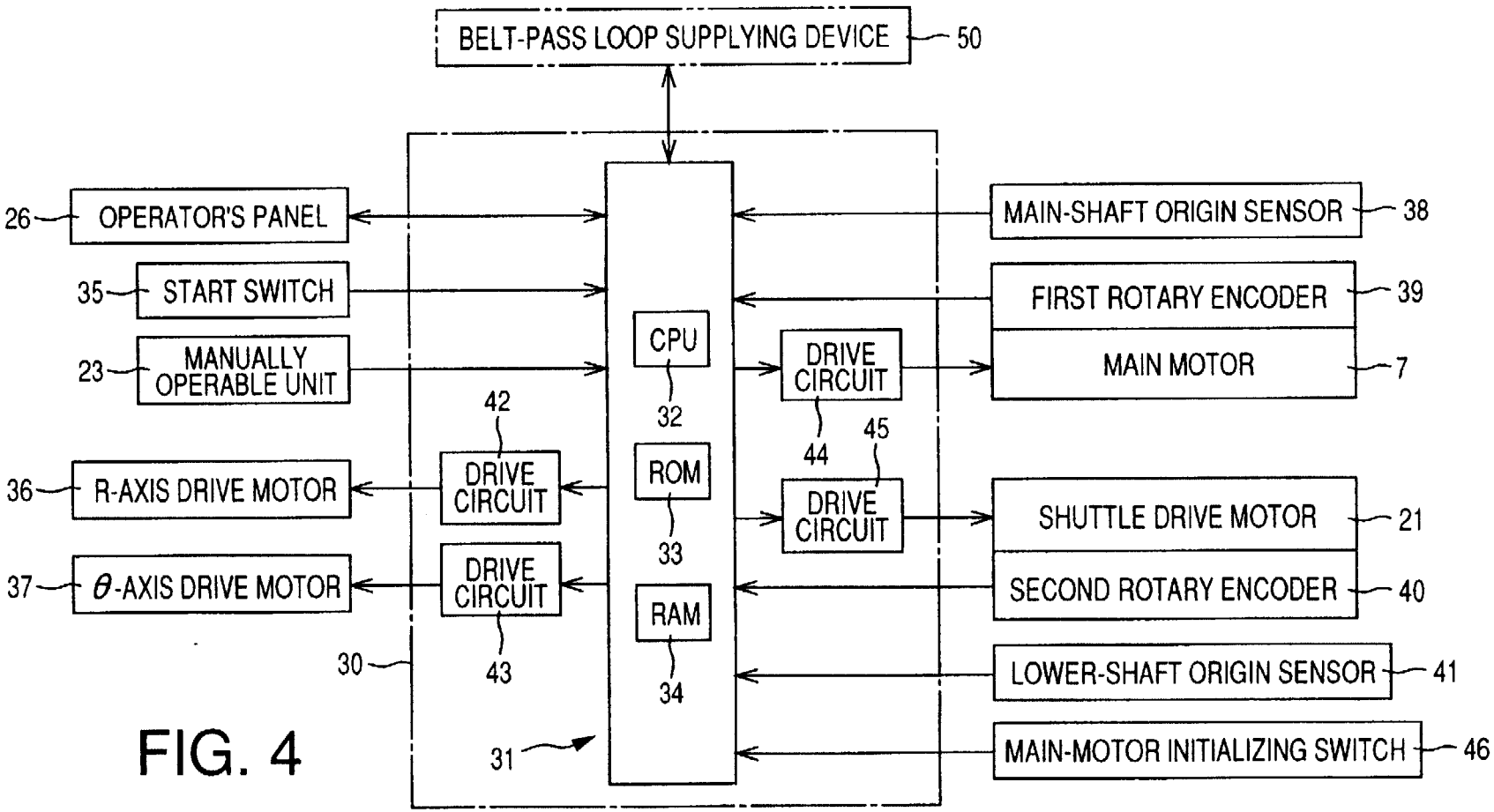
FIG. 4 is a diagrammatic view of an electric arrangement of the sewing machine of FIG. 1 which includes a control device.

As shown in FIG. 4, the control device 30 includes a microcomputer 31 which is essentially provided by a central processing unit (CPU) 32, a read only memory (ROM) 33, a random access memory (RAM) 34. The microcomputer 31 is connected via bus (e.g., data bus) to an input interface (not shown) and an output interface (not shown). A START switch 35, the operator's panel 26, the manually operable unit 23, the main-shaft origin sensor 38, a first rotary encoder 39 associated with the main motor 7, a second rotary encoder 40 associated with the shuttle drive motor 21, a lower-shaft origin sensor 41, and a main-motor initializing switch 46 are electrically connected to the input interface of the control device 30, such that the elements 35, 26, 23, 38, 39, 40, 41, 46 supply respective signals to the control device 30. The first or second rotary encoder 39, 40 corresponds to a second sensor. Moreover, the first encoder 39 corresponds to a main-motor sensor. The switch 46 is operated for selecting a main-motor initializing mode in which the main motor 7 is connected by the operator to the main shaft 6 via the coupling member 14 such that a reference rotation position of the output shaft 7*a* of the main motor 7 substantially coincides with the origin rotation position of the main shaft 6 corresponding to the upper dead position of the needle bar 8.

The control device 30 supplies drive signals or drive pulse signals via the output interface to the LCD 24 of the operator's panel 26, a drive circuit 42 for driving an R-axis drive motor 36 of the feeding mechanism which moves, in the X direction, a support plate (not shown) on which an object to be sewn is placed, a drive circuit 43 for driving a θ-axis drive motor 37 of the feeding mechanism which moves the support plate in the Y direction, a drive circuit 44 for driving the main motor 7, and a drive circuit 45 for driving the shuttle drive motor 21. Each of the main motor 7 and the shuttle drive motor 21 is provided by an AC (alternating current) servomotor.

Figure 12:
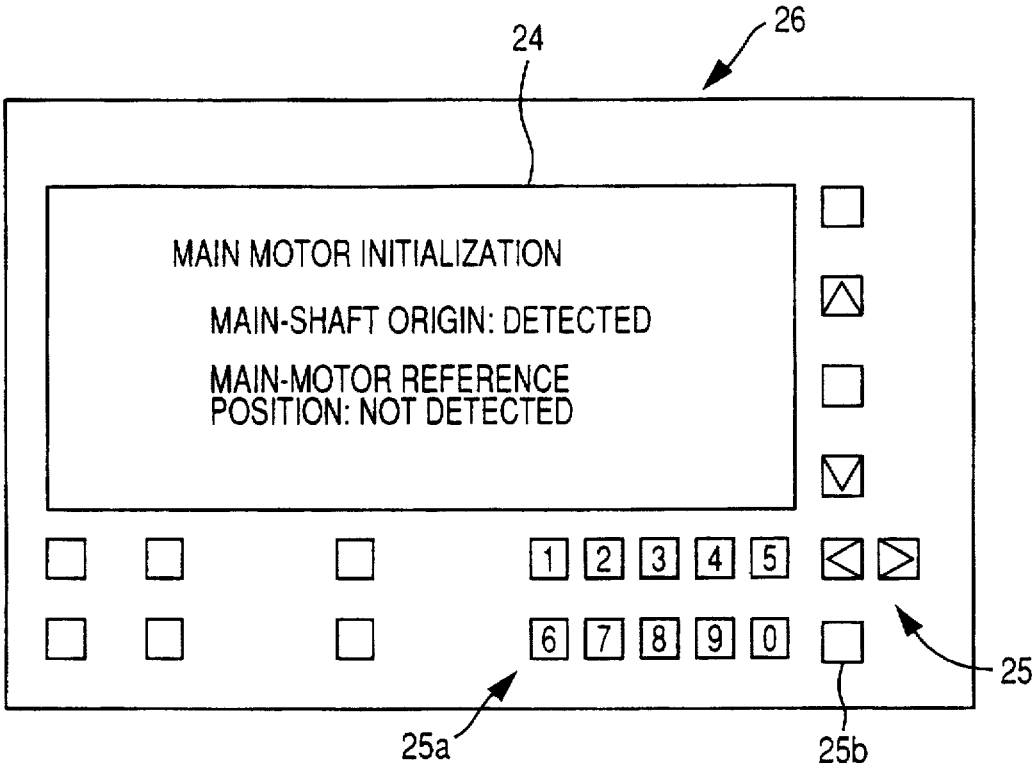
FIG. 12 is a view of an image displayed on a display of the sewing machine of FIG. 1 that indicates that only a main-shaft origin has been detected while the sewing machine is operated according to the main-motor initializing routine of FIG. 7.

As shown in FIG. 12, the operator's panel 26 includes the large-size liquid crystal display (LCD) 24, and the keyboard 25 which has ten numeral keys 25*a* numbered "0" to "9", respectively, and various functions keys including a sewing start key 25*b* operable for starting a sewing operation. The keyboard 25 is operable for displaying, on the LCD 24, a selected one of various images so that the operator inputs various data through the image being displayed.

The lower-shaft origin sensor 41 generates a lower-shaft origin signal when it detects an origin rotation position of the second lower shaft or second shuttle 16 which corresponds to the 0° (i.e., origin rotation position) of the main shaft 6, that is, the upper dead position of the needle bar 8. The lower-shaft origin sensor 41 has the same construction as that of the main-shaft origin sensor 38. A semicircular detection plate (not shown) similar to the plate 47 is fixed to the second lower shaft (not shown), which is connected to the motor 21 with a coupling member (not shown) similar to the coupling member 14 and two set vises (not shown) similar to the two set vises 14*a*, 14*b*.

The first rotary encoder 39 generates a number of clock pulse signals as the main motor 7 is driven and accordingly the output shaft 7*a* is rotated, and additionally generates one reference-position signal while the output shaft 7*a* is rotated by 360°. The second rotary encoder 40 generates a number of clock pulse signals as the shuttle drive motor 21 is driven and accordingly the second lower shaft is rotated, and additionally generates one reference-position signal while the second lower shaft is rotated by 360°.

The ROM 33 as a non-volatile memory stores a plurality of batches of pattern data which represent a plurality of different bar-like stop stitch patterns, respectively, such that the batches of pattern data are associated with corresponding pattern-designating numbers. The ROM 33 additionally stores various control programs used for controlling various operations of the present sewing machine 1, and particularly stores sewing control programs used for controlling a sewing operation of the present machine 1 which will be described later. For example, the sewing control programs include a synchronizing control program used for synchronizing the rotation of the second lower shaft with the rotation of the main shaft 6, based on the respective clock pulse signals supplied from the first and second rotary encoders 39, 40; and a main-motor initializing control program used for controlling the LCD 24 to indicate that the main shaft 6 is taking its origin rotation position and that the main motor 7 is taking its reference rotation position, when the main motor 7 is connected to the main shaft 6 with the coupling member 14 and the set vises 14*a*, 14*b*. Thus, both the synchronizing control program and the main-motor initializing control program are stored in the same ROM 33. Therefore, those two programs can be simultaneously written or stored in the ROM 33 and accordingly the ROM 33 can be treated with ease. The RAM 34 has various work memories, buffers, and counters.

Next, there will be described the sewing control programs according to which the computer 31 of the control device 30 of the sewing machine 1 operates, by reference to the flow charts shown in FIGS. 6 to 11.

In order to connect the main motor 7 to the main shaft 6 such that the reference rotation position of the motor 7 is substantially aligned with the origin rotation position of the shaft 6, first, the operator connects the output shaft 7*a* of the motor 7 to the coupling member 14 by fastening one set screw 14*b*, and operates the main-motor initializing switch 46 to the position of "ON". Then, the operator operates the START switch 35 to supply the sewing machine 1 with electric power. In this state, the other set screw 14*a* remains loose and accordingly the main shaft 6 is not connected to the coupling member 14.

Upon application of the electric power to the sewing machine 1, the CPU 32 of the control device 30 starts with Step S10 to judge whether the main-motor initializing switch 46 is ON. In the above-indicated state, a positive judgment is made at Step S10, the CPU 32 establishes a main-motor initializing mode and goes to Step S17, that is, the main-motor initializing routine shown in FIG. 7.

First, at Step S20, the CPU 32 controls the display 24 to display a main-motor-initialization-related image, as shown in FIG. 12, which includes characters and/or symbols indicating whether the origin of the main shaft 6 has been detected and whether the reference position of the main motor 7 has been detected. The operator manually rotates the main shaft 6, little by little, in one direction. Step S20 is followed by Step S21 to judge whether the control device 30 is receiving the main-shaft origin signal from the main-shaft origin sensor 38. The origin sensor 38 generates the origin signal when the L-level needle-position signal is changed to the H-level needle-position signal, that is, when the needle bar 8 substantially reaches its upper dead position, as shown in FIG. 5. If a negative judgment is made at Step S21, the control of the CPU 32 goes to Step S23 to operate the display 24 to indicate that the main-shaft origin has not been detected. Step S23 is followed by Step S24 to judge whether the control device 30 is receiving the main-motor reference-position signal from the first rotary encoder 39. The rotary encoder 39 generates the reference-position signal when the main motor 7 is taking its reference rotation position. If a negative judgment is made at Step S24, the control of the CPU 32 goes to Step S26 to operate the display 24 to indicate that the main-motor reference position has not been detected. Then, the control of the CPU 32 goes back to Step S21. Meanwhile, if a positive judgment is made at Step S21, the control of the CPU 32 goes to Step S22 to operate the display 24 to indicate that the main-shaft origin has been detected, as shown in FIG. 12.

Figure 13:
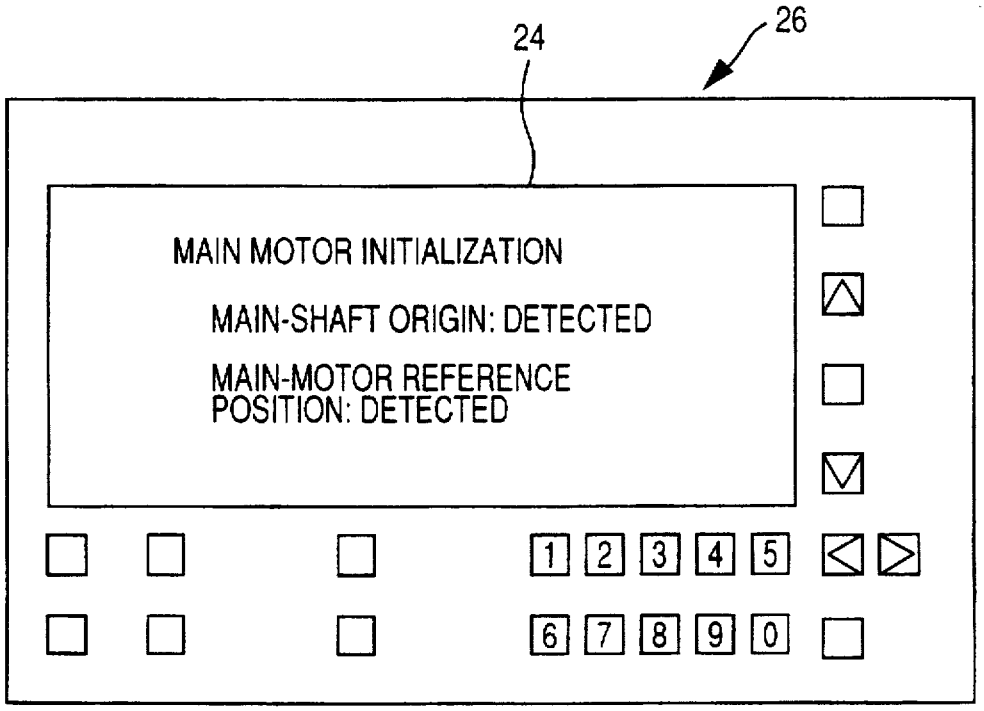
FIG. 13 is a view of another image displayed on the display of the sewing machine of FIG. 1 that indicates that both the main-shaft origin and a main-motor reference position have been detected.

Subsequently, the operator manually rotates the output shaft 7*a* of the main motor 7 or the coupling member 14 connected to the shaft 7*a*, little by little, in one direction. If a positive judgment is made at Step S24, the control of the CPU 32 goes to Step S25 to operate the display 24 to indicate that the main-motor reference position has been detected, as shown in FIG. 13.

Thus, the operator can easily find, from the image indicated on the display 24, the origin of the main shaft 6 which corresponds to the upper dead position of the needle bar 8, and also find the reference position of the main motor 7. In this state, the operator fastens the set screw 14*a* so that the main motor 7 is connected to the main shaft 6 such that the origin of the main shaft 6 is substantially aligned with the reference position of the main motor 7. Then, the operator cuts the electric power from the sewing machine 1 to end the control routine of FIG. 7, and operates the switch 46 to the position of "OFF". Subsequently, the operator applies the electric power to the sewing machine 1, again.

Figure 8:
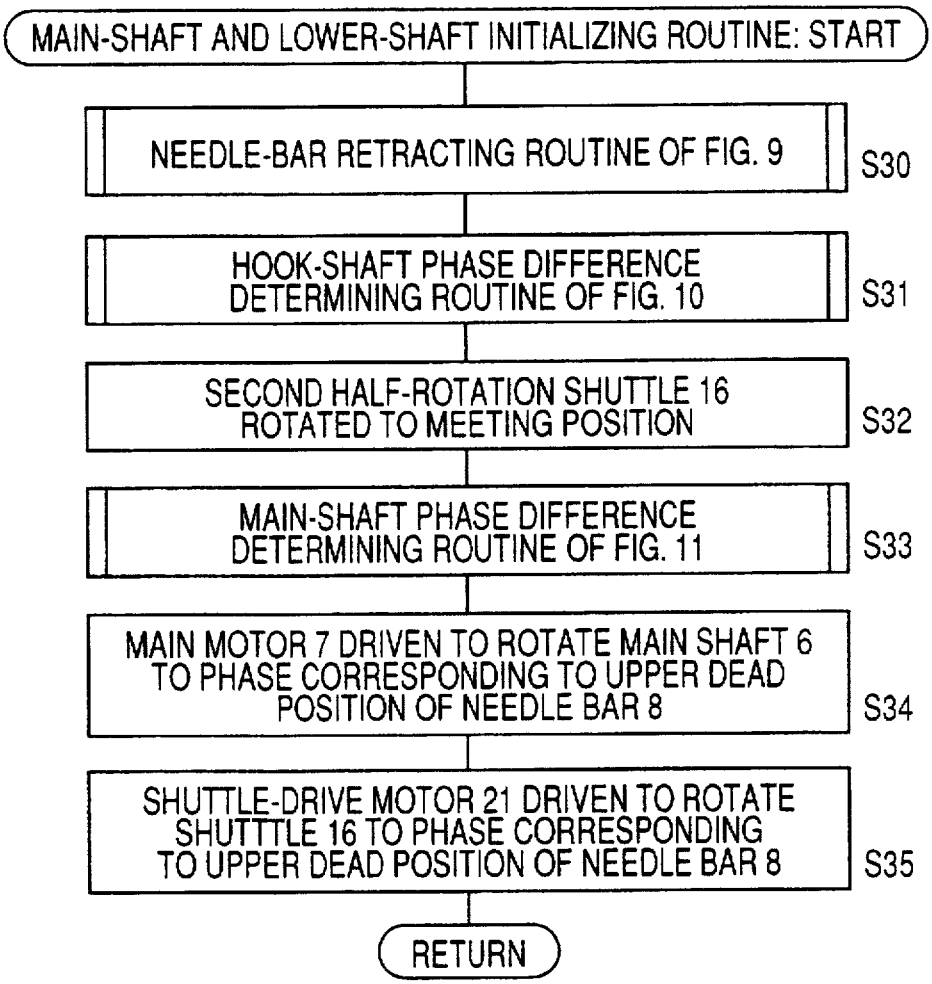
FIG. 8 is a flow chart representing a main-shaft and lower-shaft initializing routine as part of the sewing control program shown in FIG. 6.

In the above-indicated state, upon application of the electric power to the sewing machine 1, a negative judgment is made at Step S10, and the control of the CPU 32 goes to Step S11, that is, the main-shaft and lower-shaft (second shuttle 16) initializing routine, shown in FIG. 8, in which the main shaft 6 is rotated to its origin position or phase corresponding to the upper dead position of the needle bar 8 and the lower shaft or second shuttle 16 is rotated to its origin position or phase corresponding to the upper dead position of the needle bar 8.

Figure 9:
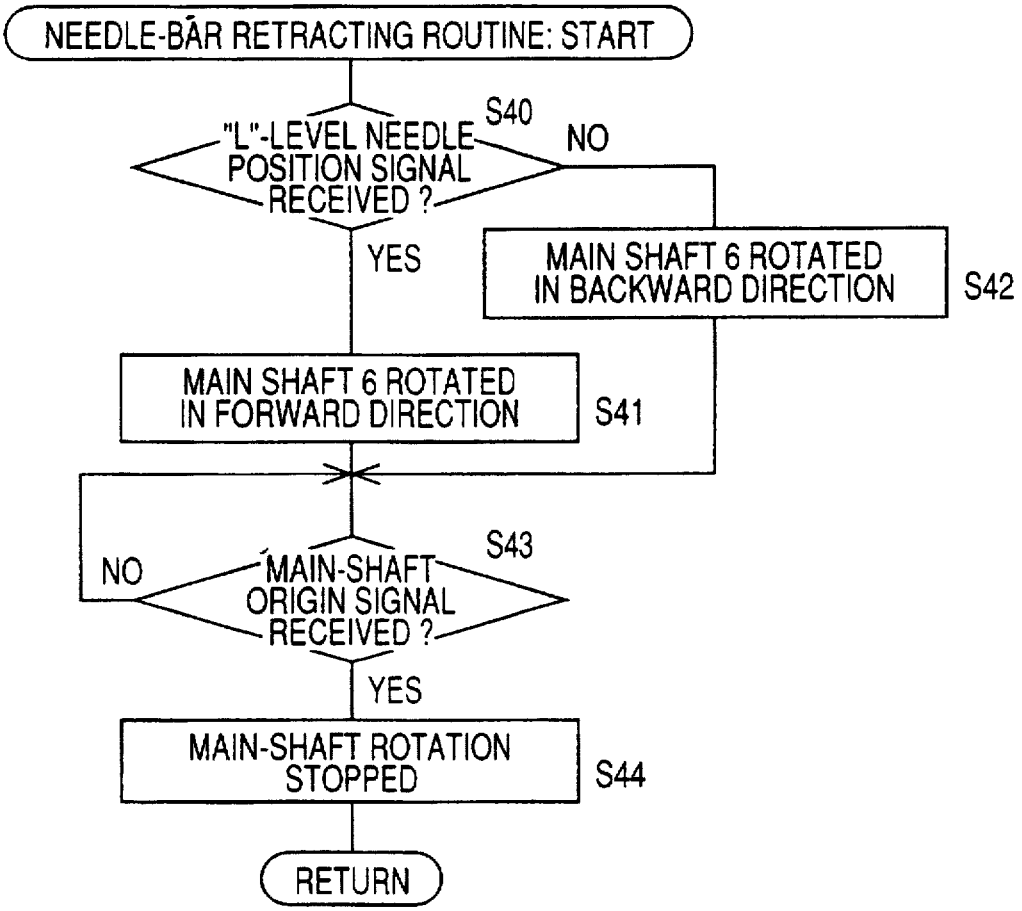
FIG. 9 is a flow chart representing a needle-bar retracting routine as part of the sewing control program shown in FIG. 6.

In the flow chart of FIG. 8, first, the control of the CPU 32 goes to Step S30, that is, the needle-bar retracting routine shown in FIG. 9.

In the flow chart of FIG. 9, first, the control of the CPU 32 goes to Step S40 to judge whether the control device 30 is receiving the L-level needle-position signal from the main-shaft origin sensor 38. A positive judgment made at Step S40 means that the needle bar 8 is currently positioned midway in the direction of movement from its lower dead position toward its upper dead position, as shown in FIG. 5. In this case, the control of the CPU 32 goes to Step S41 to drive the main motor 7 and rotate the output shaft 7*a*, at a low speed, in the direction corresponding to the above-indicated direction of movement of the needle bar 8 (hereinafter, referred to as the "forward" direction), so that the main shaft 6 is rotated in the same direction and the bar 8 substantially reaches its upper dead position as a result of movement over the shorter distance than the distance over which the bar 8 would be moved when the shaft 6 would be rotated in the opposite direction. Step S41 is followed by Step S43 to judge whether the control device 30 is receiving the main-shaft origin signal from the main-shaft origin sensor 38. If a positive judgment is made at Step S43, the control of the CPU 32 goes to Step S44 to stop the rotation of the main shaft 6 in the forward direction. Then, the control of the CPU 32 goes to Step S31 of FIG. 8.

On the other hand, when the control device 30 is receiving the H-level needle-position signal from the main-shaft origin sensor 38, that is, when the needle bar 8 is currently positioned midway in the direction of movement from its upper dead position toward its lower dead position, as shown in FIG. 5, a negative judgment is made at Step S40 and the control of the CPU 32 goes to Step S42 to drive the main motor 7 and rotate the output shaft 7*a*, at a low speed, in the opposite direction (hereinafter, referred to as the "backward" direction), so that the main shaft 6 is rotated in the same direction and the bar 8 substantially reaches its upper dead position as a result of movement over the shorter distance than the distance over which the bar 8 would be moved when the shaft 6 would be rotated in the forward direction. Step S42 is followed by Step S43. If a positive judgment is made at Step S43, the control of the CPU 32 goes to Step S44 to stop the rotation of the main shaft 6 in the backward direction. Then, the control of the CPU 32 goes to Step S31 of FIG. 8.

Figure 10:
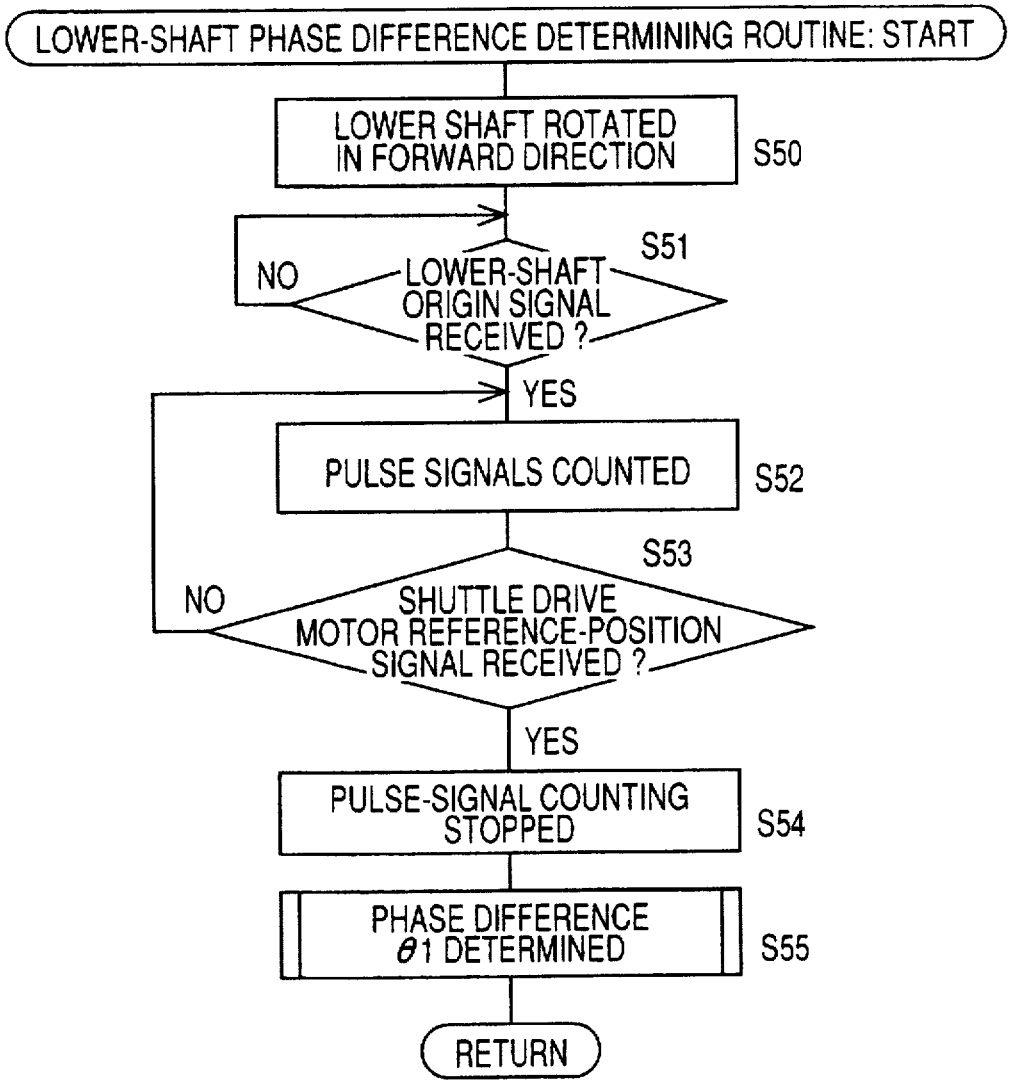
FIG. 10 is a flow chart representing a lower-shaft phase difference determining routine as part of the sewing control program shown in FIG. 6.

Following Step S30, the control of the CPU 32 goes to Step S31, that is, the lower-shaft phase difference determining routine, shown in FIG. 10, in which a phase difference between the origin of the lower shaft or second shuttle 16 and the reference position of the shuttle drive motor 21 is determined.

First, at Step S50, the CPU 32 controls the shuttle drive motor 21 to rotate the second lower shaft connected to the second shuttle 16, at a low speed, in the forward direction. Step S50 is followed by Step S51 to judge whether the control device 30 is receiving the lower-shaft origin signal from the lower-shaft origin sensor 41. The origin sensor 41 generates the origin signal when the second lower shaft or second shuttle 16 is rotated to its origin corresponding to the upper dead position of the needle bar 8. If a positive judgment is made at Step S51, the control of the CPU 32 goes to Step S52 to start counting the number of clock pulse signals generated by the second rotary encoder 40. Step S52 is followed by Step S53 judge whether the control device 30 is receiving the shuttle-drive-motor reference-position signal from the second rotary encoder 40. The rotary encoder 40 generates the reference-position signal when the drive motor 21 is taking its reference rotation position. If a negative judgment is made at Step S53, Steps S52 and S53 are repeated. Meanwhile, if a positive judgment is made at Step S53, the control of the CPU 32 goes to Step S54 to stop counting the number of clock pulse signals supplied from the second rotary encoder 40. Step S54 is followed by Step S55 to calculate, based on the counted clock-pulse-signal number, a phase difference, θ1, (degrees) between the origin of the lower shaft or second shuttle 16 and the reference position of the shuttle drive motor 21, and store the calculated phase difference θ1 in an appropriate work memory of the RAM 34. Then, the control of the CPU 32 goes to Step S32 of FIG. 8.

At Step S32, the CPU 32 controls the shuttle drive motor 21 to rotate the second lower shaft or second shuttle 16 to a predetermined rotation position or angular phase where a point of hook of the shuttle 16 meets the sewing needle 11*b* in an actual sewing operation. In this state, however, the needle bar 8 has substantially been retracted to its upper dead position at Step S30 and accordingly the point of hook is prevented from colliding with the sewing needle 11*b*.

Figure 11:
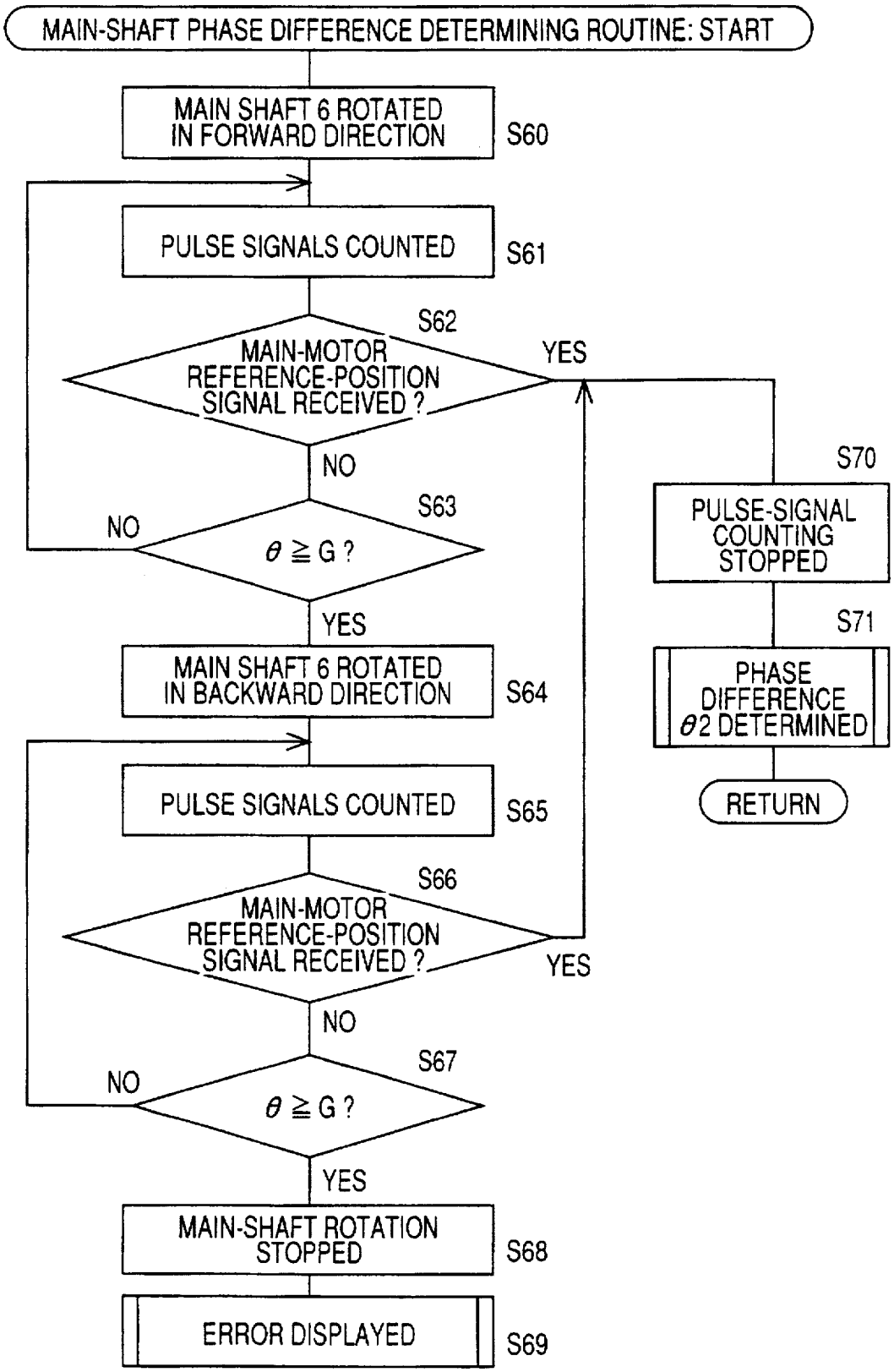
FIG. 11 is a flow chart representing a main-shaft phase difference determining routine as part of the sewing control program shown in FIG. 6.

Next, the control of the CPU 32 goes to Step S33, that is, the main-shaft phase difference determining routine, shown in FIG. 11, in which a phase difference between the origin of the main shaft 6 and the reference position of the main motor 7 is determined. Although the main motor 7 can be connected to the main shaft 6 such that the origin of the shaft 6 is substantially aligned with the reference position of the motor 7, according to the routine shown in FIG. 7, an excessively great phase difference may be produced between the two positions because of, e.g., loosening of the set screw or screws 14*a*, 14*b*.

First, at Step S60, the CPU 32 controls the main motor 7 to rotate the main shaft 6, at a low speed, in the forward direction. Step S60 is followed by Step S61 to start counting the number of clock pulse signals generated by the first rotary encoder 39. Step S61 is followed by Step S62 judge whether the control device 30 is receiving the main-motor reference-position signal from the first rotary encoder 39. The rotary encoder 39 generates the reference-position signal when the main motor 7 is taking its reference rotation position. If a negative judgment is made at Step S62, the control goes to Step S63 to calculate, based on the counted clock-pulse-signal number, a phase or angle, θ, (degrees) of rotation of the main shaft 6 as measured from its origin position or phase and judge whether the angle θ is not smaller than a predetermined angle, G. The angle G is predetermined at, e.g., about 10° in the forward direction from the origin of the main shaft 6, so as to ensure that when the needle bar 8 connected to the main shaft 6 is moved down as the shaft 6 is rotated in the forward direction, the sewing needle 11*b* may not collide with the second shuttle 16. If a negative judgment is made at Step S63, Steps S61, 62, and S63 are repeated. Meanwhile, if a positive judgment is made at Step S62 while the angle θ remains smaller than the angle G, the control of the CPU 32 goes to Step S70 to stop counting the number of clock pulse signals supplied from the first rotary encoder 39. Step S70 is followed by Step S71 to calculate, based on the counted clock-pulse-signal number, a phase difference, θ2, (degrees) between the origin of the main shaft 6 and the reference position of the main motor 7, and store the calculated phase difference θ2 in an appropriate work memory of the RAM 34. Then, the control of the CPU 32 goes to Step S34 of FIG. 8.

By the way, if the angle θ increases up to be equal to, or greater than, the angle G before the control device 30 receives the main-motor reference position signal from the first rotary encoder 39, a positive judgment is made at Step S63. In this case, the control of the CPU 32 goes to Step S64 to drive the main motor 7 and rotate the main shaft 6, in the backward direction so that the shaft 6 goes back to its origin position, and subsequently further rotate the shaft 6 in the backward direction. Step S64 is followed by Step S65 to start counting the number of clock pulse signals generated by the first rotary encoder 39. Step S65 is followed by Step S66 judge whether the control device 30 is receiving the main-motor reference-position signal from the first rotary encoder 39. If a negative judgment is made at Step S66, the control goes to Step S67 to calculate, based on the counted clock-pulse-signal number, a phase or angle, θ, (degrees) of rotation of the main shaft 6 in the backward direction as measured from its origin position or phase and judge whether the angle θ is not smaller than a predetermined angle, G. The angle G is predetermined at, e.g., about 10° in the backward direction from the origin of the main shaft 6.

If a negative judgment is made at Step S66, Steps S65, 66, and S67 are repeated. Meanwhile, if a positive judgment is made at Step S66 while the angle θ remains smaller than the angle G, the control of the CPU 32 goes to Step S70 to stop counting the number of clock pulse signals supplied from the first rotary encoder 39, and further to Step S71 to calculate, based on the counted clock-pulse-signal number, a phase difference, θ2, (degrees) between the origin of the main shaft 6 and the reference position of the main motor 7, and store the calculated phase difference θ2 in an appropriate work memory of the RAM 34.

On the other hand, if the angle θ increases up to be equal to, or greater than, the angle G before the control device 30 receives the main-motor reference position signal from the first rotary encoder 39 at Step S66, a positive judgment is made at Step S67. In this case, the control of the CPU 32 goes to Step S68 to stop the operation of the main motor 7 to rotate the main shaft 6, so as to prevent the sewing needle 11*b* from being moved down and colliding with the second shuttle 16. Step S68 is followed by Step S69, that is, error displaying routine in which the CPU 32 controls the display 24 to display an error message indicating that the reference position of the main motor 7 is not appropriately aligned with the origin of the main shaft 6. Thus, the phase difference θ2 is determined with reliability while the sewing needle 11*b* is effectively prevented from colliding with the second shuttle 16, even if the angle θ may be excessively great. Then, the control of the CPU 32 goes to Step S34 of FIG. 8.

At Step S34, the CPU 32 controls the main motor 7 to rotate the main shaft 6 so that the needle bar 8 reaches its upper dead position. Step S34 is followed by Step S35 to control the shuttle drive motor 21 to rotate the second lower shaft to its origin so that the second shuttle 16 is rotated to the predetermined position corresponding to the upper dead position of the needle bar 8. Thus, the needle bar 8 and the second shuttle 16 are initialized. Then, the control of the CPU 32 goes to Step S12 of FIG. 6.

At Step S12, the CPU 32 reads, from the ROM 33, a batch of sewing data which has been designated by operation of the keyboard 25*a*. Step S12 is followed by Step S13 to control the display 24 to display a sewing-related image containing a plurality of sets of sewing-related data including the name of the designated sewing pattern, the sewing speed, etc.

Step S13 is followed by Step S14 to judge whether the keyboard 25 has been operated, and subsequently by Step S15 to judge whether the sewing start key 25*b* has been operated. If a positive judgment is made at each of Steps S14 and S15, the control of the CPU 32 goes to Step S18, that is, sewing-operation controlling routine to carry out a sewing operation according to the designated batch of sewing data. In the sewing-operation controlling routine, the control device 30 controls the shuttle drive motor 21 to rotate the second lower shaft in synchronism with the rotation of the main shaft 6 by the main motor 7, based on the respective clock signals supplied from the first and second rotary encoders 39, 40. In addition, the control device 30 controls the two motors 36, 37 of the feeding mechanism. Thus, two bar-like stop stitch patterns are simultaneously formed on opposite ends of the belt-passing loop supplied from the supplying device 50. Then, the control goes back to Step S14.

By the way, if any key other than the sewing start key 25*b* is operated, a negative judgment is made at Step S15, and the control goes to Step S16 to carry out an operation corresponding to the operated key. Then, the control goes back to Step S14.

As is apparent from the foregoing description, the main-motor is initialized as follows: The output shaft 7*a* of the main motor 7 is connected to the coupling member 14 with one set screw 14*b*, while the other set screw 14*a* remains loose and accordingly the main shaft 6 is not connected to the coupling member 14. An electric power is applied to the sewing machine 1 after the main-motor initializing switch 46 has been turned to the position of "ON". In this state, the display 24 displays the main-motor-initialization-related image as shown in FIG. 12. The operator slowly rotates, with his or her hand, the main shaft 6 in the direction to move up the needle bar 8 toward its upper dead position. When the needle bar 8 substantially reaches its upper dead position and therefore the control device 30 receives the main-shaft origin signal from the main-shaft origin sensor 38, the control device 30 controls the display 24 to indicate that the main-shaft origin is being detected.

Next, the output shaft 7*a* of the main motor 7, or the coupling member 14 is manually rotated slowly in one direction, while the main shaft 6 is not rotated. When the reference position of the main motor 7 is detected by the first rotary encoder 39, the control device 30 controls the display 24 to indicate that the main-motor reference position is being detected. In this state, the operator fastens the set screw 14*a* to fix the main shaft 6 to the coupling member 14. Thus, the main motor 7 is connected to the main shaft 6 via the coupling device 14, 14*a*, 14*b*, such that the reference position of the main motor 7 is substantially aligned with the origin position of the main shaft 6. Then, the operator cuts the electric power from the sewing machine 1, turns the switch 46 to the position of "OFF", and applies the electric power again to the sewing machine 1.

Subsequently, the main shaft 6 is initialized as follows: First, the main motor 7 is driven to rotate the main shaft 6 in a direction to move up the needle bar 8 to its upper dead position corresponding to the origin position of the shaft 6. The control device 30 determines or selects this direction based on the needle-position signal supplied from the main-shaft origin sensor 38. Then, the main motor 7 is rotated in the forward or normal direction. If the reference position of the main motor 7 is detected before the rotation amount or angle θ of the output shaft 7*a* of the motor 7 in the formal direction becomes greater than the predetermined angle G, the control device 30 determines the rotation angle θ at the time of detection of the main-motor reference position, as the phase difference θ2 between the main-shaft origin position and the main-motor reference position. On the other hand, if the main-motor reference position is not detected before the rotation angle θ exceeds the predetermined angle G, the main motor 7 is rotated in the backward or reverse direction. If the main-motor reference position is detected before the rotation angle θ in the backward direction as measured from the main-shaft origin position exceeds the predetermined angle G, the control device 30 determines the rotation angle θ at the time of detection of the main-motor reference position, as the phase difference θ2 between the main-shaft origin position and the main-motor reference position. On the other hand, if the main-motor reference position is not detected before the rotation angle θ exceeds the predetermined angle G, the control device 30 controls the display 24 to display an error message indicating that the main motor 7 is inappropriately connected to the main shaft 6.

Thus, in the present embodiment, the main motor 7 can be connected to the main shaft 6 such that only a small phase difference θ2 is present between the reference position of the main motor 7 and the origin position of the main shaft 6 corresponding to the upper dead position of the needle bar 8. Therefore, the main motor 7 need not be provided with any indicia indicative of its reference position, and enjoys an accordingly reduced cost. In addition, the main motor 7 can be easily connected to the main shaft 6.

In the present embodiment, the semicircular detection plate 47 is fixed to the main shaft 6, and the main-shaft origin sensor 38 generates the H-level needle-position signal when the needle bar 8 moves down from its upper dead position toward its lower dead position and generates the L-level needle-position signal when the needle bar 8 moves up from its lower dead position toward its upper dead position, as shown in FIG. 5. In addition, when the sensor 38 detects one radial edge 47*a* of the detection plate 47 which is indicative of the main-shaft origin position corresponding to the upper dead position of the needle bar 8, the sensor 38 generates the main-shaft origin signal. Thus, the control device 30 can easily determine or select the direction of rotation of the main motor 7 in which the needle bar 8 is directly moved to its upper dead position without being moved via its lower dead position. Therefore, the sewing needle 11*b* can be effectively prevented from colliding with the second shuttle 16. Since the main-shaft origin sensor 38 also functions as a needle-position sensor, the present sewing machine 1 need not employ an exclusive needle-position sensor for detecting a current position of the sewing needle 11*b*.

Although not shown, the shuttle drive motor 21 is connected to the second lower shaft (not shown) via a coupling member and set screws similar to those members 14, 14*a*, 14*b* shown in FIG. 1, and the lower-shaft origin sensor 41 has the same construction as that of the main-shaft origin sensor 38 shown in FIG. 1. Therefore, the second shuttle drive motor 21 can be initialized according to the same routine as the main-shaft initializing routine shown in FIG. 7, such that the reference position of the motor 21 is substantially aligned with the origin position of the second lower shaft.

While the present invention has been described in its preferred embodiment, the present invention may otherwise be embodied.

For example, when the main-shaft origin position or the main-motor reference position is detected by the main-shaft origin sensor 38 or the first rotary encoder, the control device 30 may light a first or a second lamp, respectively, or may operate a speaker to generate a first or a second sound, respectively.

Figure 14:
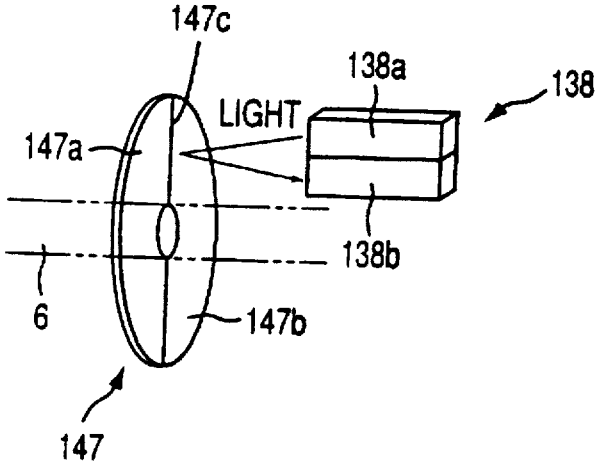
FIG. 14 is a perspective view of a main-shaft origin sensor and a circular detection plate of another sewing machine as another embodiment of the present invention.

As shown in FIG 14, the semicircular detection plate 47 may be replaced by a circular detection plate 147 including two semicircular portions 147*a*, 147*b* having different reflection coefficients, respectively, and the transmission-type main-shaft origin sensor 38 may be replaced by a reflection-type photodetector 138 including a light emitter 138*a* for emitting a light toward the circular plate 147 and a light receiver 138*b* for receiving the light reflected by each of the two semicircular portions 147*a*, 147*b*. One 147*c* of two radial boundaries which are opposite to each other with respect to the main shaft 6 and which cooperate with each other to separate the two semicircular portions 147*a*, 147*b* from each other, corresponds to the origin position of the main shaft 6. Otherwise, the origin sensor 38 may be replaced by any of various known switches and sensors such as a proximity switch or a limit switch.

When the main-motor reference position is not detected before the rotation angle θ of the main motor 7 in each direction exceeds the angle G, the control device 30 may light an error lamp.

Figure 7:
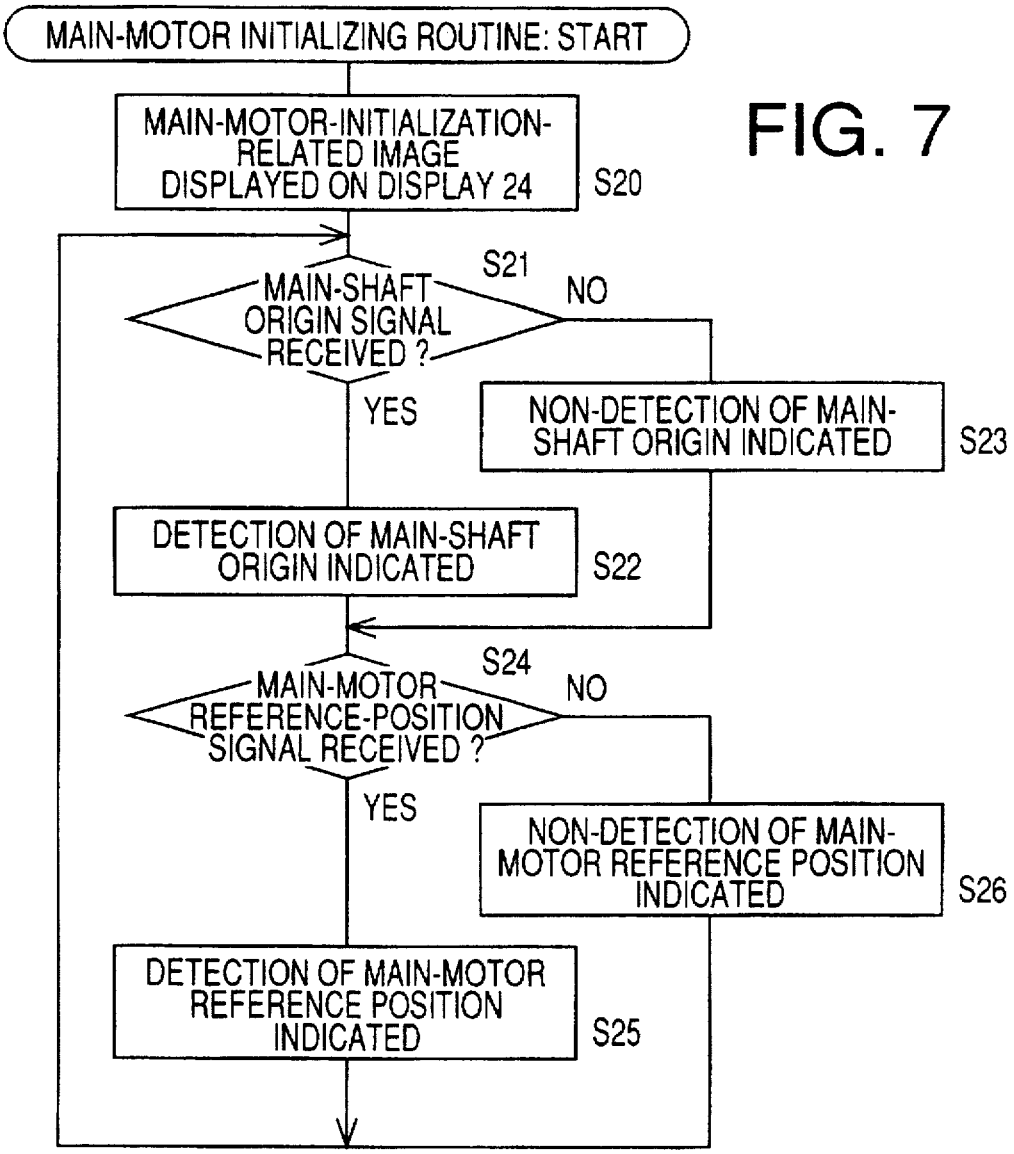
FIG. 7 is a flow chart representing a main-motor initializing routine as part of the sewing control program shown in FIG. 6.

The present sewing machine 1 may be modified such that while the machine 1 is supplied with an electric power, a special key may be operated by an operator to select the main-motor initializing routine shown in FIG. 7, or a sewing control routine starting with Step S11 shown in FIG. 6.

The principle of the present invention may be applicable to a sewing machine employing a full-rotation shuttle or hook in place of the half-rotation shuttle 16, or a sewing machine employing a single sewing needle in place of the two sewing needles 11*a*, 11*b*.

It is to be understood that the present invention may be embodied with other changes, improvements and modifications that may occur to those skilled in the art without departing from the scope and spirit of the invention defined in the appended claims.

What is claimed is:

1. A sewing machine comprising:

a needle bar to which a sewing needle conveying a sewing thread is secured;

a main shaft to which said needle bar is connected;

a loop catcher which cooperates with the sewing needle to catch a loop of the sewing thread conveyed by the needle;

a catcher shaft to which said loop catcher is connected;

a drive motor which drives at least one of said needle bar and said loop catcher by rotating a corresponding one of said main shaft and said catcher shaft;

a first sensor which detects a first reference rotation position of at least one of said main shaft and said catcher shaft and generates a first detection signal indicating that said one shaft is taking said first reference rotation position;

a second sensor which detects a second reference rotation position of said drive motor and generates a second detection signal indicating that said drive motor is taking said second reference rotation position; and an indicating device which indicates, based on said first detection signal, that said one of said main shaft and said catcher shaft is taking said first reference rotation position and indicates, based on said second detection signal, that said drive motor is taking said second reference rotation position.

2. A sewing machine according to claim 1, wherein said drive motor comprises a main motor which drives at least said needle bar by rotating said main shaft, wherein said first sensor comprises a main-shaft sensor which detects the first reference rotation position of said main shaft and generates the first detection signal indicating that said main shaft is taking the first reference rotation position, wherein said second sensor comprises a main-motor sensor which detects the second reference rotation position of said main motor and generates the second detection signal indicating that said main motor is taking the second reference rotation position, and wherein said indicating device indicates, based on said first detection signal, that said main shaft is taking said first reference rotation position and indicates, based on said second detection signal, that said main motor is taking said second reference rotation position.

3. A sewing machine according to claim 2, wherein said drive motor further comprises a catcher drive motor which is independent of said main motor and which drives said loop catcher by rotating said catcher shaft.

4. A sewing machine according to claim 3, wherein said main-motor sensor generates a rotation-position detection signal representative of a current rotation position of said main motor, and wherein the sewing machine further comprises a control device which controls said catcher drive motor, based on said rotation-position detection signal, such that said catcher drive motor rotates said catcher shaft in synchronism with the rotation of said main shaft by said main motor.

5. A sewing machine according to claim 4, further comprising a non-volatile memory which stores a first control program according to which said indicating device operates, and a second control program according to which said control device operates.

6. A sewing machine according to claim 1, wherein said drive motor comprises a catcher drive motor which drives said loop catcher by rotating said catcher shaft, wherein said first sensor comprises a catcher-shaft sensor which detects the first reference rotation position of said catcher shaft and generates the first detection signal indicating that said catcher shaft is taking the first reference rotation position, wherein said second sensor comprises a catcher-drive-motor sensor which detects the second reference rotation position of said catcher drive motor and generates the second detection signal indicating that said catcher drive motor is taking the second reference rotation position, and wherein said indicating device indicates, based on said first detection signal, that said catcher shaft is taking said first reference rotation position and indicates, based on said second detection signal, that said catcher drive motor is taking said second reference rotation position.

7. A sewing machine according to claim 1, wherein said indicating device comprises a display which displays at least one of a first character and a first symbol indicating that said at least one of said main shaft and said catcher shaft is taking said first reference rotation position and displays at least one of a second character and a second symbol indicating that said drive motor is taking said second reference rotation position.

8. A sewing machine according to claim 1, wherein said indicating device comprises a speaker which generates a first sound indicating that said at least one of said main shaft and said catcher shaft is taking said first reference rotation position and generates a second sound indicating that said drive motor is taking said second reference rotation position.

9. A sewing machine according to claim 1, wherein said indicating device comprises a first lamp which is turned on to indicate that said at least one of said main shaft and said catcher shaft is taking said first reference rotation position, and a second lamp which is turned on to indicate that said drive motor is taking said second reference rotation position.

10. A sewing machine according to claim 1, wherein said first sensor comprises a detection plate which is secured to said at least one of said main shaft and said catcher shaft, and a detection signal generator which generates said first detection signal having a first feature while said detection plate is rotated about said one shaft within a first half angular range of 180 degrees, and generates said first detection signal having a second feature while said detection plate is rotated within a second half angular range of 180 degrees which does not overlap said first half angular range.

11. A sewing machine according to claim 10, wherein said detection plate comprises a semicircular plate which is secured to said at least one of said main shaft and said catcher shaft and which has two radial edges which are opposite to each other with respect to said one shaft, one of said two radial edges corresponding to said first reference rotation position of said one shaft.

12. A sewing machine according to claim 11, wherein said detection signal generator comprises a transmission-type photodetector which emits a light toward said semicircular plate and receives the emitted light and which generates said first detection signal having said first feature indicating that the emitted light has not been received because of interruption of said semicircular plate and generates said first detection signal having said second feature indicating that said emitted light has been received.

13. A sewing machine according to claim 11, wherein said two radial edges correspond to an upper and a lower dead position of said needle bar connected to said main shaft, respectively.

14. A sewing machine according to claim 10, wherein said detection plate comprises a circular plate which is secured to said at least one of said main shaft and said catcher shaft and which includes two semicircular portions having different reflection coefficients, respectively, said circular plate having two radial boundaries which are opposite to each other with respect to said one shaft and which cooperate with each other to separate said two semicircular portions from each other, one of said two radial boundaries corresponding to said first reference rotation position of said one shaft.

15. A sewing machine according to claim 14, wherein said detection signal generator comprises a reflection-type photodetector which emits a light toward said circular plate and receives the light emitted and reflected by said circular plate and which generates said first detection signal having said first feature indicating that the emitted light has been reflected by one of said two semicircular portions and generates said first detection signal having said second feature indicating that said emitted light has been reflected by the other of said two semicircular portions.

16. A sewing machine according to claim 1, further comprising a coupling device which couples an output shaft of said drive motor with said at least one of said main shaft and said catcher shaft, such that said drive motor is detachable from said one shaft.

17. A sewing machine according to claim 1, further comprising an error informing device which informs that a phase difference between said first and second reference rotation positions is greater than a predetermined angle.

18. A sewing machine comprising:

a needle bar to which a sewing needle conveying a sewing thread is secured;

a main shaft to which said needle bar is connected;

a loop catcher which cooperates with the sewing needle to catch a loop of the sewing thread conveyed by the needle;

a catcher shaft to which said loop catcher is connected;

a drive motor which drives at least one of said needle bar and said loop catcher by rotating a corresponding one of said main shaft and said catcher shaft; and a rotation-position sensor which detects a reference rotation position of at least one of said main shaft and said catcher shaft and generates a first detection signal indicating that said one shaft is taking said reference rotation position, said rotation-position sensor including a detection plate which is secured to said at least one of said main shaft and said catcher shaft, and a signal generator which generates a second detection signal having a first feature while said detection plate is rotated about said one shaft within a first half angular range of 180 degrees, and generates said second detection signal having a second feature while said detection plate is rotated within a second half angular range of 180 degrees which does not overlap said first half angular range.

19. A sewing machine according to claim 18, wherein said detection plate comprises a semicircular plate which is secured to said at least one of said main shaft and said catcher shaft and which has two radial edges which are opposite to each other with respect to said one shaft, one of said two radial edges corresponding to said reference rotation position of said one shaft.

20. A sewing machine according to claim 19, wherein said signal generator comprises a transmission-type photodetector which emits a light toward said semicircular plate and receives the emitted light and which generates said first detection signal having said first feature indicating that the emitted light has not been received because of interruption of said semicircular plate and generates said first detection signal having said second feature indicating that said emitted light has been received.

21. A sewing machine according to claim 19, wherein said two radial edges correspond to an upper and a lower dead position of said needle bar connected to said main shaft, respectively.

22. A sewing machine according to claim 18, wherein said detection plate comprises a circular plate which is secured to said at least one of said main shaft and said catcher shaft and which includes two semicircular portions having different reflection coefficients, respectively, said circular plate having two radial boundaries which are opposite to each other with respect to said one shaft and which cooperate with each other to separate said two semicircular portions from each other, one of said two radial boundaries corresponding to said reference rotation position of said one shaft.

23. A sewing machine according to claim 22, wherein said detection signal generator comprises a reflection-type photodetector which emits a light toward said circular plate and receives the light emitted and reflected by the circular plate and which generates said first detection signal having said first feature indicating that the emitted light has been reflected by one of said two semicircular portions and generates said first detection signal having said second feature indicating that said emitted light has been reflected by the other of said two semicircular portions.

24. A sewing machine according to claim 23, wherein said two radial boundaries correspond to an upper and a lower dead position of said needle bar connected to said main shaft, respectively.

* * * * *